United States Patent [19]

Dose

[11] 4,122,692

[45] Oct. 31, 1978

[54] DEVICE FOR TANNING, DYEING OR THE LIKE

[76] Inventor: Werner Dose, Lindenstrasse 12, D-7585 Lichtenau-Grauelsbaum, Fed. Rep. of Germany

[21] Appl. No.: 841,803

[22] Filed: Oct. 13, 1977

[30] Foreign Application Priority Data

Oct. 23, 1976 [DE] Fed. Rep. of Germany ..... 2648057

[51] Int. Cl.[2] ..... C14C 1/00

[52] U.S. Cl. ..... 69/30

[58] Field of Search ..... 69/29, 30, 31, 32; 68/142, 144, 208; 134/5, 155, 159

[56] References Cited

U.S. PATENT DOCUMENTS

| | | | |
|---|---|---|---|
| 3,457,742 | 6/1969 | Heidemann et al. | 69/30 |
| 3,664,161 | 5/1972 | Cressman | 69/30 |
| 3,841,909 | 10/1974 | Nonaka et al. | 69/30 |

*Primary Examiner*—Patrick D. Lawson
*Attorney, Agent, or Firm*—Michael J. Striker

[57] ABSTRACT

The device for tanning, dyeing or the like, comprises a horizontal rotary drum mounted on a hollow shaft and having a cylindrical drum jacket, which is sealed at the front ends by means of closing walls and contains in its interior a tanning or dyeing compartment subdivided into three treatment chambers by means of three perforated equiangularly spaced radial partition walls. The rotary drum comprises on its exterior a number of pockets corresponding to the number of the treatment chambers, each pocket being in joint communication with respectively two treatment chambers. During the rotation of the rotary drum in one direction of rotation the treatment medium emerges approximately radially from a treatment chamber and enters a pocket in the area of one frontal drum end from which a partial stream flows into another pocket to be mixed with the treatment medium disposed in this pocket and then approximately radially into a treatment chamber. The other partial stream flows simultaneously to the opposite drum end into an associated pocket, is mixed with the treatment medium contained therein, and flows from this pocket approximately inwards into the same treatment chamber. Rotation of the rotary drum in the direction of rotation opposite thereto causes a corresponding scooping of the treatment medium to occur at the other frontal drum end and in the opposite flow direction.

29 Claims, 12 Drawing Figures

DEVICE FOR TANNING, DYEING OR THE LIKE

The invention relates to a device for tanning, dyeing or the like, comprising a horizontal rotary drum which comprises a preferably cylindrical drum jacket, which is sealed at the front ends by means of closing walls and contains in its interior a tanning or dyeing compartment which is accessible via closable charging openings in the drum jacket for loading and unloading, and comprising a hollow shaft, which communicates with the tanning or dyeing chamber, for the drum mounting and for the drainage and/or intake of fluid treatment media.

When in operation, the rotary drums of such devices, which are for example 2.5 m in diameter and can receive approximately 2.000 kg dry leather, are driven, for example, in five-minute cycles of full rotation in one direction of rotation and thereafter in the other direction of rotation. During this process, the treatment medium, hereinafter called the liquor, it to flow again and again through the tanning or dyeing compartment in as homogeneous an intermixture as possible. To bring this about, an elaborate control system for the actuation of flaps or other control elements has so far been necessary. As a result, the device is extremely complicated, expensive and susceptible to trouble. From time to time and depending on the material to be treated, the entire liquor has to be removed from the rotary drum and the latter has to be rinsed. This, too, turns out to be extremely elaborate and complicated in known devices. Sometimes it is not possible to drain the liquor completely, lengthy rinsing operations thus being necessary. Another problem is posed by the fact that on known devices it could be ensured only at an extremely high additional expediture to check the liquor constantly or temporarily during the process of treatment with respect to specific parameters, for example the temperature, pH value etc., and to re-standardize it as necessary, for example by heating, by introducing into the liquor during the treatment process hot steam which transfers the heat formed by condensation to the liquor, or by changing the pH value, by adding highly concentrated chemicals to the mixture during the process. It is furthermore of great importance that the added hot steam or chemicals should not come into direct contact with the material undergoing treatment, since this will otherwise be damaged or destroyed and be rendered useless. Another aim is to allow such devices to be put up in as space-saving a manner as possible, despite their large dimensions, and the greatest possible use to be made thereof, while the constructional size is the same, that is to say a maximum payload with an improved treatment result, if possible. The possibility of loading and unloading the material in as problem-free a manner as possible and by machine, for example by means of fork lifts or the like, should also be provided.

It is the object of the invention to design a device of the mentioned species in such a way that these aims are attained at the lowest possible cost. Briefly, these aims are as follows: A high degree of utilization by means of maximum loadability and a better result of the treatment given while the size remains the same; a space-saving installation; continuous and thorough intermixing of the liquor during the operating in each direction of rotation; the addition of chemicals to the mixture without causing damage to the material; the introduction of hot steam, etc.; easy accessibility to the liquor during the operation for monitoring purposes and possibly for the re-standardization of the liquor; complete, rapid and reliable drainage as well as easy flushing of the rotary drum; an uncomplicated construction and low susceptibility to trouble.

According to the invention, the problem posed is solved on a device of the kind mentioned at the beginning in that the tanning or dyeing compartment of the rotary drum is subdivided by means of several, preferably three, radial partition walls, which are arranged in approximately the same angle scale relative to one another and are preferably perforated, into a number of treatment chambers corresponding to the number of the radial partition walls, which chambers are of approximately equal size and each comprise a separate closable charging opening; and in that the rotary drum comprises on its exterior at least approximately in the area of both frontal ends and in the radial direction a number of pockets corresponding to the number of treatment chambers, of which pockets each is jointly in communication with two consecutive treatment chambers in the circumferential direction; and in that the hollow shaft penetrates the rotary drum in the centre and axially and is extended beyond the frontal closing wall at one end, preferably that which is located on the drive side, and is surrounded by a coaxial pipe socket which is larger in diameter; and in that the rotary drum comprises at each axial drum end for each individual treatment chamber an approximately radial connecting line, of which those located at one frontal drum end, preferably on the drive side, open out with their one end into the annular space between the hollow shaft and the pipe socket and those at the opposite drum end open out with their one end into the interior of the hollow shaft, while all connecting lines are connected with their other end to an associated pocket in such a way that respectively two connecting lines located opposite to one another at the front ends of the drum open out in respect of each treatment chamber into the pockets which are located at the same circumferential level or are staggered in the circumferential direction so that during the rotation of the rotary drum in one direction of rotation the treatment medium will emerge approximately radially from one treatment chamber and will enter one pocket in the area of one frontal drum end and will flow from this pocket through the connecting line thereof into the annular space between the hollow shaft and the pipe socket and will flow from this latter, after having been deflected and possibly after having simultaneously undergone some treatment, such as heating, a concentration check etc., as a partial stream back through one of the connecting lines at this drum end into a pocket provided there and through this latter, while being mixed with the treatment medium disposed in this pocket, approximately radially back into a treatment chamber; the other partial stream flowing simultaneously through the hollow shaft in the axial direction to the opposite drum end and entering there, through a connecting line, an associated pocket, while being mixed with the treatment medium disposed therein, and flowing from this pocket approximately radially inwards into the same treatment chamber or one that follows in the circumferential direction; and in that during the rotation of the rotary drum there is effected in the opposite direction of rotation a corresponding scooping of the treatment medium at the other frontal drum end and in the opposite flow direction.

Due to the subdivision of the tanning and dyeing compartment into several, for example three, treatment chambers, the utilization thereof is increased while the drum size is the same. It is possible to load more material for treatment, and at the same time a better treatment result is given. Handling is also considerably improved. Each treatment chamber can be fed separately, for example by means of a fork lift. A contributing factor is that the rotary drum can be arranged so that at least a portion of its radial dimension is embedded in the floor, because there is no need for any elaborate flaps, which must be accessible for maintenance and repair purposes, and other special control elements for the flow of the liquor. The liquor is again and again thoroughly mixed during the operation and is thus chemically homogeneous and, for example, with respect to its temperature at any location of the drum. This happens thanks to the pockets, connecting lines and channels in the hollow shaft and the pipe socket. When the drum rotates in one direction of rotation, the liquor flows from the treatment chambers in the radial direction into the pockets. It does then not come again directly into contact with the material undergoing treatment but is scooped off at one frontal drum end, depending on the direction of rotation. The liquor is drained through the connecting lines at one drum end and is introduced into the pipe socket. From there, it returns, after having been deflected, in the form of a partial stream through the connecting lines at the same end and again into the pockets, where it is thoroughly mixed with the remaining liquor portion, before the return flow takes place into the treatment chambers and to the material undergoing treatment. The other partial stream passes through the hollow shaft over its entire axial length and is introduced at the other frontal drum end through the connecting lines provided there into the pockets provided there, wherein there also occurs a mixing with the remaining liquor before the return flow into the treatment chambers and to the material undergoing treatment takes place. These flow patterns simultaneously lead to an extremely thorough mixing of the liquor, as viewed in the axial direction, and to a liquor which, also in this direction, is homogeneous to a high degree with respect to concentration, temperature and other parameters. Due to the perforations in the radial partition walls of each treatment chamber, there also occurs a thorough mixing from chamber to chamber. Upon a reversal of the direction of rotation, the flow occurs in the opposite sense. The liquor then flows from the pockets, for example those at the end remote from the drive, into the connecting lines provided there and flows from there into the hollow shaft and through this latter to the other end. After the reversal of the flow direction, a partial stream flows back through the hollow shaft and through the connecting lines at the end remote from the drive into the pockets provided there and then, after having been mixed with the remaining liquor, once again into the treatment chambers. The other partial stream passes through the pipe socket at the drive end into the connecting lines provided there, the pockets connected thereto and then, after having been mixed with the remaining liquor, into the treatment chambers. It is thus ensured that good flow conditions are provided in both directions of rotation and that the liquor is scooped from the treatment chambers and flows back into the treatment chambers only after having been mixed with the residual liquor left in the drum. There is no need for any expensive control system of flaps, valves or the like, in order to bring about these flow patterns. The device is thus simple in construction, extremely cheap and practically trouble-free in operation. At the same time, the flow guidance provides the possibility of having access to the liquor itself at any time during the operation, that is to say during the rotation of the rotary drum and the flow of the liquor, so as to monitor it with respect to, for example, concentration, temperature or other parameters and, if necessary, to re-standardize it. This may be effected in the area of the pipe socket. Here, for example highly concentrated chemicals may be added or hot steam may be supplied by means of a steam injector for heating the liquor. Before the thus enriched liquor comes again into contact with the material undergoing treatment, it is first thoroughly mixed with the liquor left in the drum in the manner mentioned, so that a liquor that is already thoroughly mixed enters the treatment chambers. Any danger of the material undergoing treatment being damaged is thus completely prevented. The complete draining or flushing of the rotary drum now also does not present any problems. All one needs to do for draining is to shut off the return flow through the pipe socket and the hollow shaft, and then the drum can be drained completely. Flushing with water is also easy, since this can be introduced at the same point and it is ensured that the water, like the liquor, will reach each location of the drum during the operation and can thereafter also drain completely. All these advantages allow an installation of the rotary drum in the floor. By this means, it is also possible to gain easier access to the changing openings for loading and unloading, for example by means of fork lifts. It is of advantage for loading and unloading if of the two radial partition walls dividing a treatment chamber in the circumferential direction one radial partition wall forms, irrespective of the direction in which the rotary drum rotates, a feeding base facilitating the loading of the treatment chamber by machine and an unloading chute facilitating the unloading thereof. For loading, the drum is stopped in a position of rotation in which a radial partition wall of the treatment chamber to be fed is inclined towards the bottom and the centre, thus forming a filling chute, along which the loaded material slides of its own accord towards the centre. For unloading, the drum is stopped in a position of rotation in which a radial partition wall assumes a position directed towards the charging opening and inclined towards the bottom, so that the radial partition wall then acts as an unloading chute.

In an advantageous constructional form, provision is made for the hollow shaft to be subdivided over its entire length by means of radial dividing webs, which go as far as eht centre and extend as radial extensions of the radial partition walls, into a number of axial channels corresponding to the number of treatment chambers and for those of the connecting lines, provided for each treatment chamber, which are connected to the interior of the hollow shaft to open into the axial channel which is associated with the respective treatment chamber and extends within this latter. Provision may furthermore be made for the annular space between the pipe socket and the hollow shaft to be subdivided over the entire pipe socket length by means of radial webs extending as radial extensions of the dividing webs of the hollow shaft into a number of socket channels corresponding to the number of treatment chambers. The arrangement will then be such that of the connecting lines provided for each treatment chamber those which are connected to the annular space of the pipe socket open into that socket channel which is associated with the respective treatment chamber and extends as an axial extension thereof. This ensures that, when the drum rotates in one direction of rotation and the scooping action occurs, for example, at the frontal drum end at which the pipe socket sits, the liquor is introduced from a treatment chamber through the connecting line associated therewith into the pipe socket channel associated with this treatment chamber. The liquor contained in this particular treatment chamber thus flows designedly into the associated socket channel. Since the drum has continued to rotate in the direction of rotation at the point in time when the partial stream flows back through a socket channel, the return flow of the partial stream at the drive end takes place from another socket channel into another connecting line and thus into another pocket following in the direction of rotation and thereafter into the associated treatment chamber. This means that — when considering an axial end area of the drum — the liquor is directed away from one chamber and is introduced into another chamber, which also contributes to the extremely thorough mixing of the liquor. The other partial stream, which is directed to the opposite drum end, is conducted in the same manner through an axial channel of the hollow shaft and is then introduced from the axial channel into the connecting line, which is associated with the latter, at this drum end remote from the drive. This is then a connecting line which, as viewed in the direction of rotation of the drum, is staggered relative to that which has brought about the scooping-off on the drive side, so that this partial liquor stream at the end remote from the drive is also introduced via the associated pocket into another treatment chamber. Upon the reversal of the direction of rotation of the drum, approximately the same picture is produced, only in the opposite flow direction. It can thus be said that during the rotation of the rotary drum the liquor "rotates" by being withdrawn from one treatment chamber and being returned to another treatment chamber following in the direction of rotation, whereby the thorough mixing is even increased.

The radial partition walls may be corrugated in design and preferably be welded in if the rotary drum is constructed in metal. The corrugated design contributes to the stiffening of these partition walls.

In another advantageous constructional form, the device is characterised by a vessel at the axial drum end at which the pipe socket with the axially extended hollow shaft is provided, which vessel is stationary relative to the rotary drum and is connected to the free end of the pipe socket by a connecting pipe and by means of a slide ring seal. Along the transition area to the free end of the hollow shaft, the connecting pipe is subdivided into an upper half and a lower half by means of a horizontal dividing web, the channel above the dividing web forming an inflow channel from the hollow shaft and the pipe socket towards the vessel and the channel below the dividing web forming a return flow channel from the vessel back into the hollow shaft and the pipe socket. The inflow channel and the return flow channel may be connected within the vessel through a connecting channel comprising a throttle, preferably a throttle orifice, arranged in the flow direction upstream of the inlet into the return flow channel. The return flow channel, preferably the throttle orifice thereof, may be sealable by means of a shut-off valve or the like for draining the treatment medium from the rotary drum. Furthermore, the vessel may comprise a closable discharge opening which can be opened for draining so as to discharge the treatment medium from the rotary drum and the vessel. It may furthermore be of advantage if modular control elements, for example for the addition of fluid or powdery chemicals to the treatment medium, for steam heating by heat of condensation provided by means of a stream injector, for the measurement of the pH value or the temperature or the like, are connectible to the inflow channel and/or the return flow channel.

It is thus ensured that the liquor withdrawn from the treatment chambers in respectively one direction of rotation runs through the inflow channel into the vessel and, when a circulation of the liquor is desired, then returns through the return flow channel comprising the throttle orifice into the treatment chambers. For draining the drum, the throttle orifice is shut by means of the shut-off valve and the discharge opening is opened, so that the liquor can now flow from the drum via the vessel through the discharge opening. A complete drainage of the drum is brought about, which is of particularly great advantage if it contains, depending on the material undergoing treatment, for example a highly concentrated chrome liquor which is to be completely withdrawn through a special draining channel system. At the same time, rinsing water can be introduced into the drum through this drain, the shut-off valve shutting off the throttle orifice then being opened again for rinsing and a circulation of the rinsing water through the drum thus being possible. It is also possible for the admission of the rinsing water into the inflow channel or the return flow channel to occur at a different location of the vessel. Advantageous is above all that access to the liquor is provided at any time during the operation in the area of the vessel, namely either in the area of the inflow channel or the return flow channel. The liquor can thus be checked at any time with respect to specific parameters, such as the temperature or the pH value. The addition of highly concentrated fluid or powdery chemicals is possible, as required, and so is the introduction of hot steam for heating the liquor. All this can be done during the operation. The addition or introduction is effected in the area of the stationary vessel. The enrichment of the liquor is thus effected outside the rotary drum. Before the thus enriched liquor comes again into contact with the material undergoing treatment, thorough mixing with the liquor left in the drum takes place, so that the material undergoing treatment is not subjected to any damage by hot steam or highly concentrated chemicals.

It stands to reason that the rotary drum itself may consist of wood and/or plastics material and/or metal. Meant by the term connecting lines are lines in the general sense of flow technique. These connecting lines may be designed as hose or pipe lines or as special channels. They may extend outside the rotary drum, although an advantageous constructional form makes provision for the arrangement of the connecting lines in the interior of the rotary drum.

The pockets may be formed as additional containers which are additionally attached at the front ends and/or along the external circumference of the drum jacket, a communication having of course to be provided between the pockets and the treatment chambers.

It is of special advantage if the pockets are arranged within the drum jacket, as viewed in the radial direction, that is to say if they do not project externally, are not bulky and are not subjected to any danger of being damaged.

In a further advantageous constructional form, provision is made for the pockets to be arranged along both axial end areas of the drum jacket between the hollow shaft and the internal circumferential surface of the drum jacket. To this end, the arrangement may be such that frustro-conical and perforated dividing rings, which extend between the hollow shaft and the drum jacket and taper in the direction directed away from one another and towards the drum ends, are arranged within the drum jacket on the two axial end areas thereof in such a way that their edge describing the conical base circle rests against the inside of the drum jacket and is secured thereto, while their edge circumscribing the smaller frustro-conical circle rests against the respective frontal closing wall and is secured thereto. This design is particularly simple and cheap and leads to an annular space which is approximately triangular in cross section and which is enclosed between the dividing ring, on the one hand, and the drum jacket as well as the frontal closing wall, on the other hand. It may furthermore be of advantage if this annular space is clear of the radial partition walls at the two drum ends and is subdivided in the circumferential direction, approximately along the centre of the circumferential angle of a treatment chamber, by means of respectively one unperforated, approximately radical separating web into a number of ring-segment-shaped pockets corresponding to the number of treatment chambers, to which pockets there is connected respectively one connecting line with its one end. Here, the connecting lines may be hoses or pipe lines extending outside the drum interior. This is particularly simple and cheap.

Provision may furthermore be made for the ring-segment-shaped pockets to be arranged at one drum end without being staggered on the circumference and on the same circumferential level as those at the opposite drum end and for the connection of the connecting lines at one drum end to be effected with one end to the ring-segment-shaped pockets with a circumferential staggering by one pocket relative to those at the other drum end. This circumferential staggering of the connection of the connecting lines ensures that the rotary drum will scoop the liquor from the treatment chambers in both directions of rotation and will feed it to the vessel and that the liquor will thereafter be returned from the latter back into the treatment chambers. When the drum is driven in one direction of rotation, this scooping action occurs at one drum end, for example that at which the pipe socket is provided. In this case, due to the circumferential staggering, the connecting lines at the opposite drum end cannot scoop. Upon a reversal of the direction of rotation, the scooping of the liquor is then effected at the end that is remote from the drive, while there will then be no scooping at the opposite end.

In another advantageous constructional form, provision is made for there to be arranged within the drum jacket, for the formation of the pockets, a partially perforated internal jacket, which is coaxial to the former and is smaller in diameter and is preferably also sealed by means of the frontal closing walls, in such a way that an axially passing ring channel is formed between the external circumferential surface of the internal jacket and the internal circumferential surface of the drum jacket and for the ring channel to be clear of the radial partition walls and to be subdivided, in the circumferential direction along the angular area of a treatment chamber bounded between two radial partition walls, by means of respectively one unperforated longitudinal separating web passing in the axial direction into a number of axially passing pocket-forming ring-segment channels, to which respectively one connecting lines is connected with its one end, the number thereof corresponding to the number of treatment chambers. If the connection of the connecting lines is staggered in the direction of rotation, then it is ensured, here too, that when the drum rotates in one direction of rotation, a scooping action will occur at one drum end and when it rotates in the opposite direction this will occur at the other end.

It is of special advantage if the internal jacket comprises in respect of each treatment chamber an axially passing unperforated surface of approximately rectangular configuration in a development and perforations on the remaining circumference and if the longitudinal separating web is aligned in respect of each treatment chamber diagonally to the rectangular surface. This diagonal extension of the individual longitudinal separating webs, that is to say three longitudinal separating webs for three treatment chambers, has the special advantage that the liquor to be scooped from one drum end is given a special axial flow component, with which the liquor itself flows from the end opposite to the scooping end at a high flow rate in the axial direction to the end bringing about the scooping according to the direction of rotation. In all, there is achieved for the circulation of the liquor from the treatment chambers into the pockets, the connecting lines, through the hollow channels in the pipe socket and the hollow shaft and back again through the connecting lines into the pockets and the treatment chambers a very high flow rate, which also contributes to an extremely thorough and fast mixing of the liquor not only in the radial direction but also in the axial direction. The longitudinal separating webs simultaneously have the advantages of stiffening the drum between the internal jacket and the drum jacket.

Another advantageous further development provides for the two connecting lines located opposite at the frontal drum ends to open with one end into the ring-segment channel directly adjacent to the longitudinal separating web, as viewed in the circumferential direction, one ending on one side of the longitudinal separating web in one ring-segment channel divided thereby and the other ending on the other side of the longitudinal separating web, as viewed in the circumferential direction, in the divided ring-segment channel following in the circumferential direction, so that when the rotary drum rotates in one direction of rotation the treatment medium flows from the axially passing pockets towards one axial side and into the connecting lines disposed there, while when the rotation occurs in the direction of rotation opposite thereto, it flows from the pockets towards the other axial side and into the connecting lines disposed there. The flow rate is increased by the oblique position of the longitudinal separating webs which do not extend parallel to the longitudinal central axis.

It may furthermore be of advantage if the connecting lines are designed as approximately radially extending channels which are welded into the treatment chambers at the front ends and which are simultaneously formed as the frontal stiffening of the internal jacket and also the frontal closing walls. The channels may be approximately U-shaped in cross section with the U-shaped opening pointing to the respective frontal closing wall. The channels may be shut in the area of their U-shaped opening by means of the internal surface of the frontal closing wall, while they open with their radially external end via breaches in the internal jacket wall into the respectively associated ring-segment channel forming an axially passing pocket. With their radially internal end, the channels may open into the respectively associated socket channel of the pipe socket at one drum end or into the axial channel of the hollow shaft at the other drum end.

The advantage of this configuration is that the channels forming the connecting lines are not at all visible from the exterior and are integrated into the total construction, simultaneously contributing to its stiffening.

It goes without saying that a charging opening, which is sealable by means of a removable cover or a sliding cover, is provided for each treatment chamber on the drum jacket and also at the co-ordinated point of the internal jacket. Of course, this charging opening is expediently disposed on circumferential areas on which neither longitudinal separating webs nor radial longitudinal walls are provided.

In a further advantageous constructional form, provision is made for the radial partition walls to comprise over their axial and radial extensions bounding the treatment chambers pocket-shaped chambers which are perforated on both sides in the circumferential direction and which are open radially towards the exterior and into which the respectively associated ring-segment channels open out. For the formation of these chambers, the radial partition walls may be at least partially double walled. It may furthermore be of advantage if the radial partition walls have, in a corrugated configuration, in the area of respectively one corrugation trough a perforated cover wall which extends in the circumferential direction at a short distance from the corrugation trough and forms a chamber together with the corrugation trough. This configuration ensures, in the first place, a further stiffening of the radial partition walls. However, of special advantage is the factor that these chambers cause compartments to be provided which do not contain any material undergoing treatment. By this means, it is ensured that, above all due to these pocket-shaped chambers, the liquor can flow without trouble and easily from the centre radially outwards into the individual ring-segment channels as well as vice versa. Without such pocket-shaped chambers along the radial partition walls it can sometimes happen that the material undergoing treatment practically completely covers the perforations of the radial partition walls and that the liquor flow radially to the exterior and vice versa may be hindered thereby. This phenomenon is now counteracted by the pocket-shaped chambers of the radial partition walls.

In another advantageous constructional form, provision is made for at least one approximately web-like projection to be arranged on each side of the radial partition walls which protrudes approximately at right angles from the radial partition wall and projects into the respective treatment chamber. It is of course also possible to provide several of such projections, for example two such projections, each being arranged in the axial direction at distances of equal size from the frontal closing wall of the rotary drum. It is of advantage if these web-like projections are arranged, as viewed in the radial direction, at the shortest possible distance from the longitudinal axis. These web-like projections act like paddles which, when the device is rotated, cause the material to be treated to be turned around and prevent it from getting entangled. In order to avoid any damage to the material to be treated, the web-like projections are arranged as close as possible to the axis of rotation of the device, as viewed in the radial direction, since the circumferential speed is relatively low there. If a special effect is to be attained in the material undergoing treatment, for example a stretching or widening of leather, then it is also possible for the projections to be arranged radially further to the exterior or on the internal jacket of the rotary drum, when they will point radially inwards.

The invention will be explained in more detail hereinafter with reference to the exemplified embodiments shown in the drawings, in which.

Figure 1:
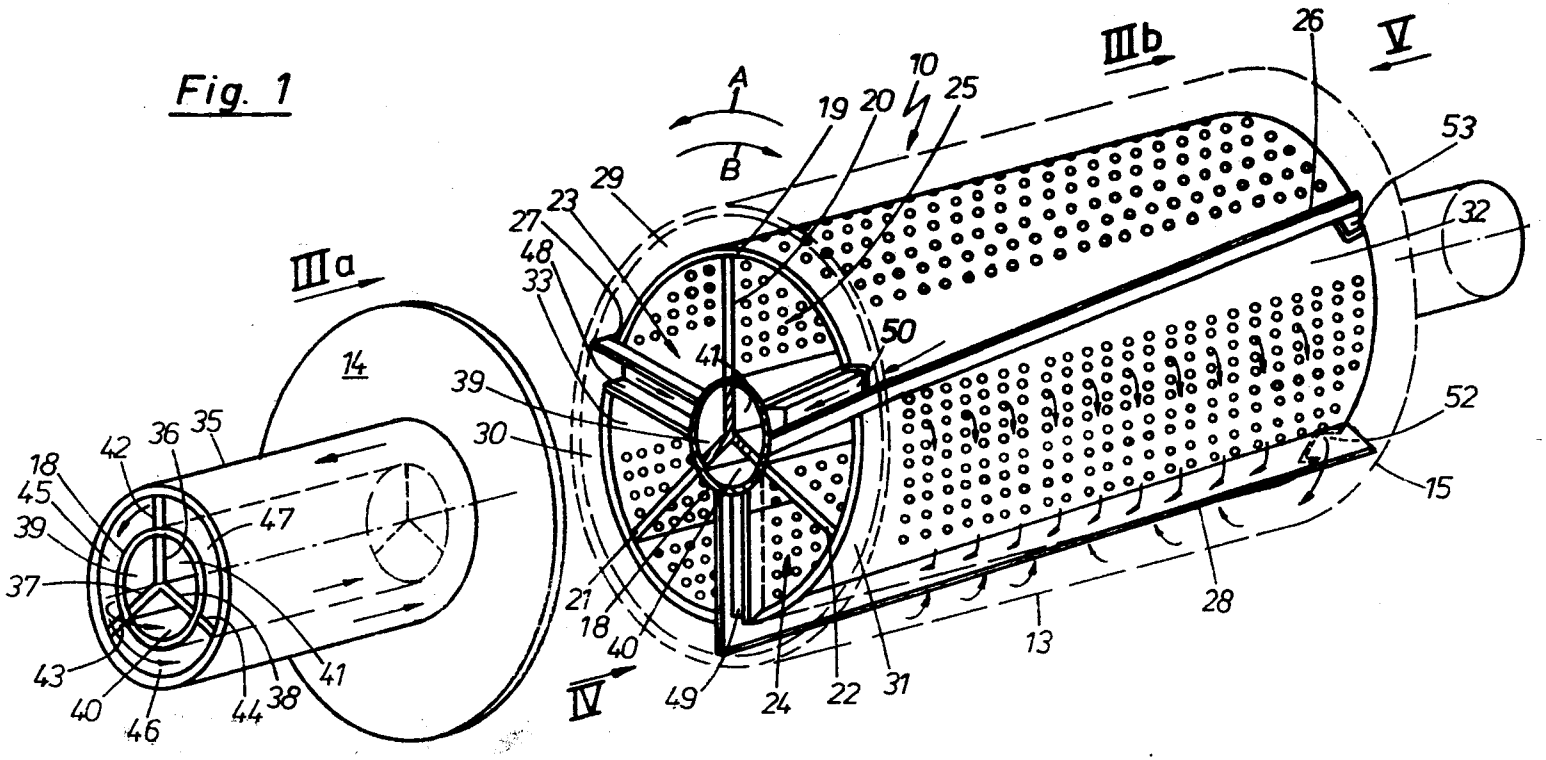
FIG. 1 shows a diagrammatical, perspective, partially sectional view of a device according to a first exemplified embodiment; a frontal closing wall having been detached and the external drum jacket only being shown in broken lines for clarity's sake.
Figure 3A:
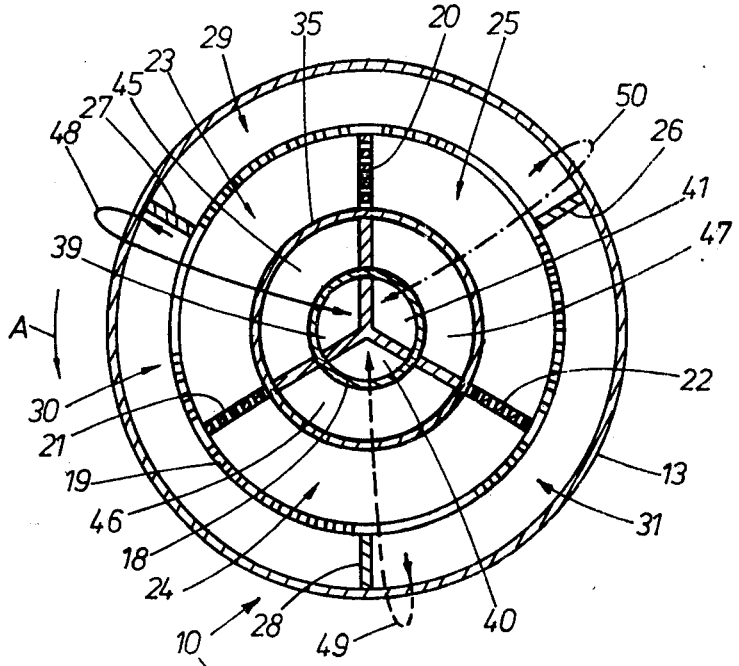
Figure 3B:
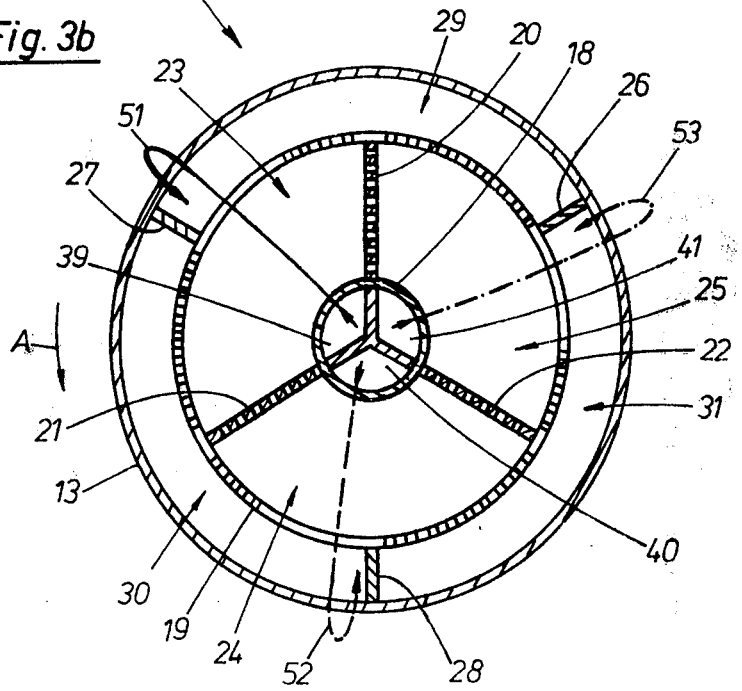
Figure 4:
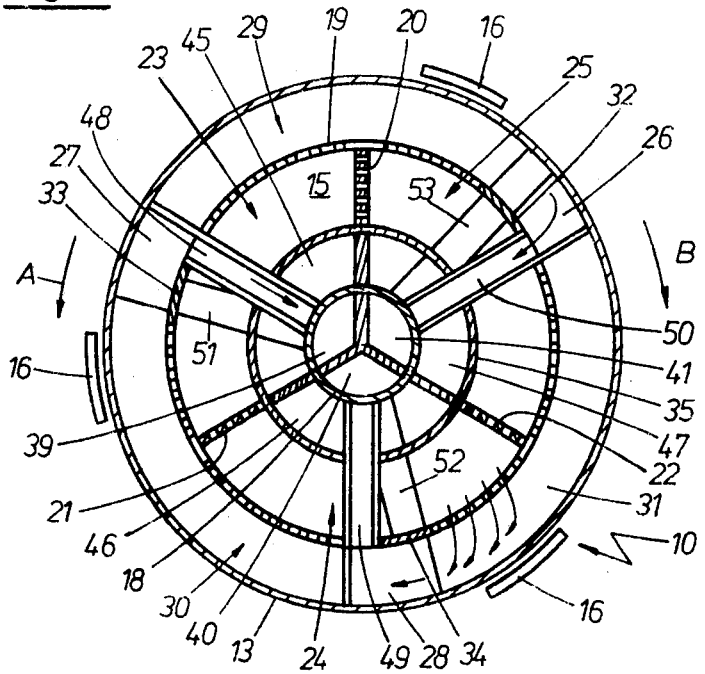
Figure 5:
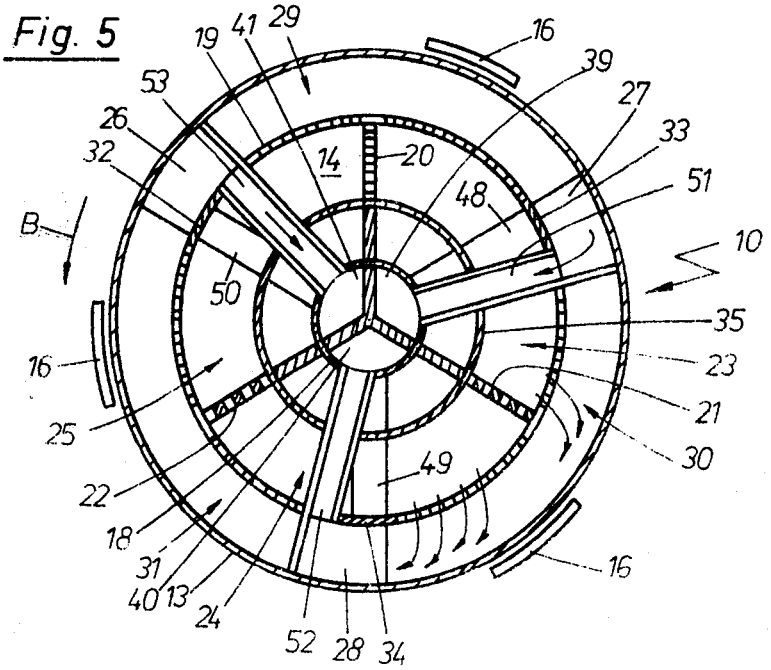
Figure 6:
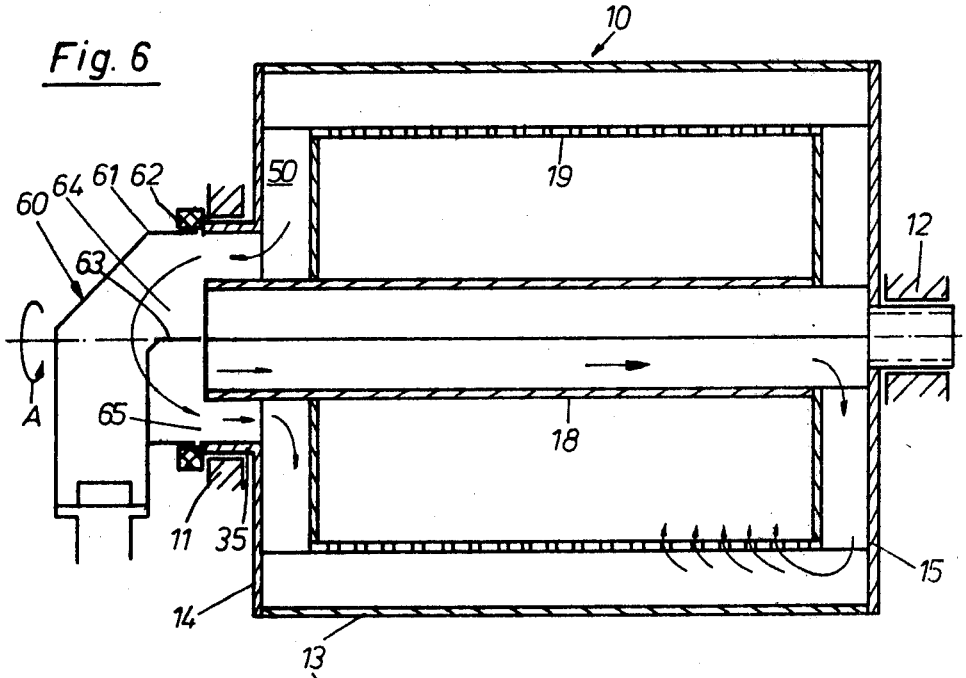
Figure 7:
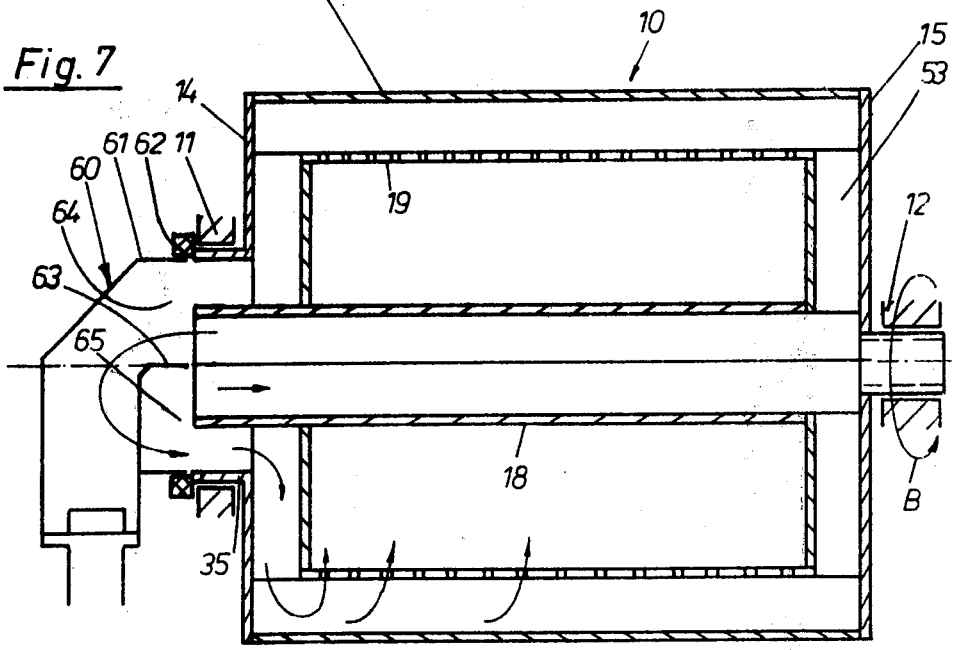
Figure 8:
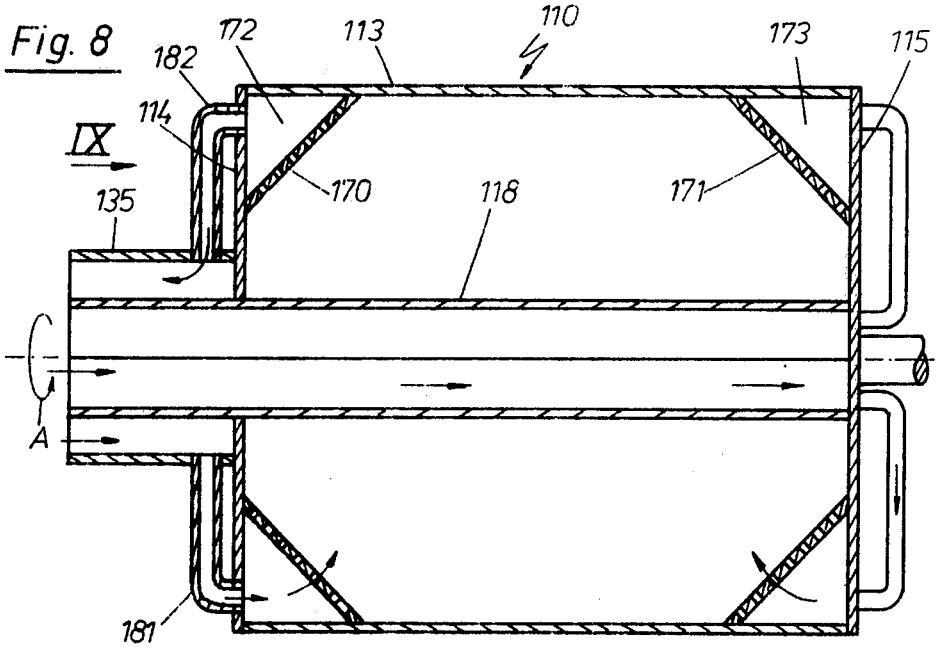
Figure 9:
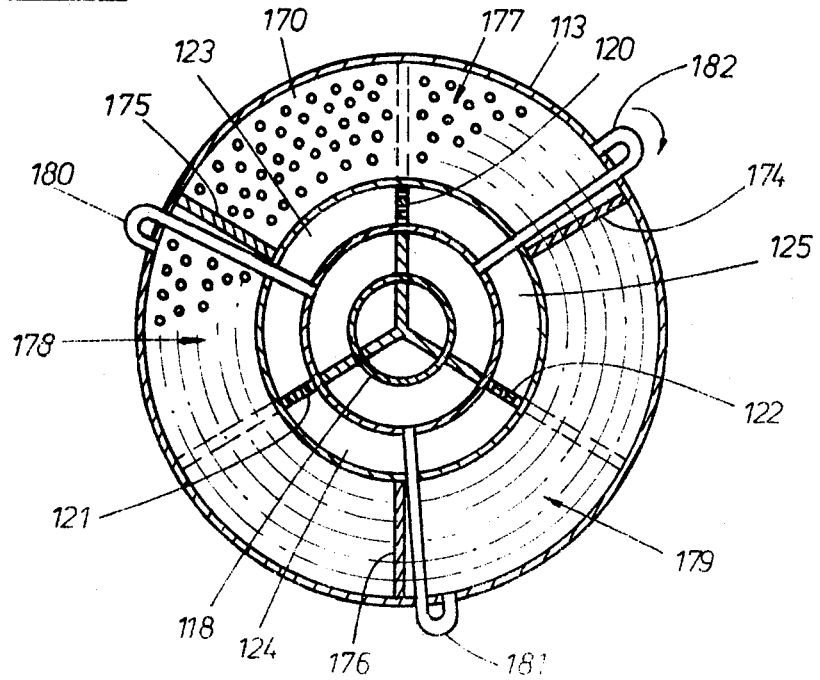
Figure 10:
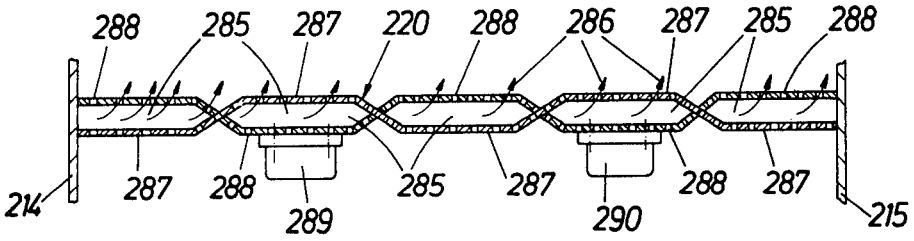
Figure 11:
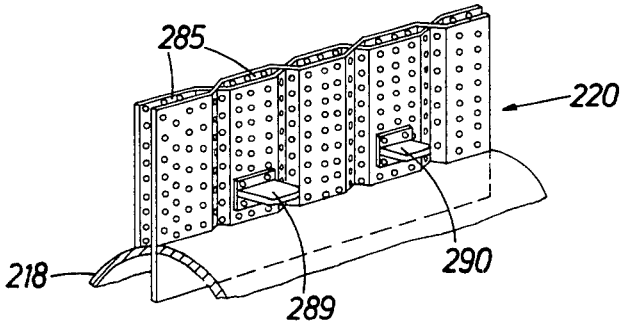

FIGS. 3*a* and 3*b* show radial sections of the rotary drum according to the first exemplified embodiment, as viewed in the direction of the arrows III*a* and III*b* in FIG. 1; the connecting lines at the end sides only being indicated as flow arrows for clarity's sake;

FIGS. 4 and 5 show radial sections of the drum with channels, as viewed in the direction of the arrows IV and V in FIG. 1;

FIGS. 6 and 7 show diagrammatical axial longitudinal sections of the entire device illustrating the flow pattern for rotation in one direction of rotation (arrow A) and in the opposite direction of rotation (arrow B);

FIG. 8 shows a diagrammatical axial longitudinal section, approximately corresponding to FIGS. 6 and 7, of a device according to a second exemplified embodiment;

FIG. 9 shows a radial section of the drum in the direction of the arrow IX in FIG. 8;

FIG. 10 shows an axial longitudinal section of a radial partition wall according to a third exemplified embodiment;

FIG. 11 shows a diagrammatical perspective representation of the radial partition wall of FIG. 10.

Figure 2:
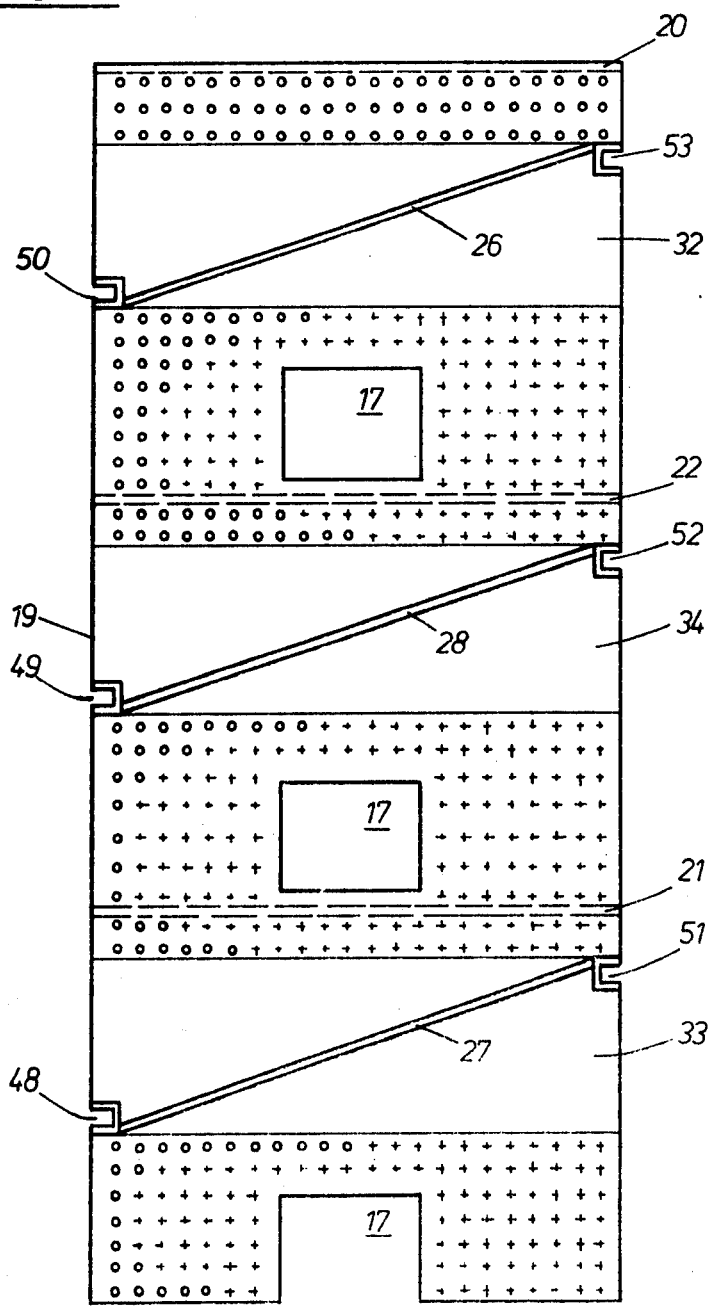
FIG. 2 shows a diagrammatical top view of the development of the internal jacket with longitudinal separating webs of the device according to FIG. 1.

The device according to the first exemplified embodiment, shown in FIGS. 1 to 7, comprises a horizontally arranged rotary drum 10 which is driven at the end side that is to the left in FIG. 1 by means of a drive which is not shown in detail and which is rotatably mounted at both ends by means of bearings 11 and 12 (FIGS. 6, 7) and which is driven, for example, so that it fully rotates in a five-minute reversal in the direction of rotation according to the arrow A and thereafter in the opposite direction of rotation according to the arrow B. The rotary drum 10 has on its exterior a metallic tightly welded cylindrical drum jacket 13 which is shut at both front ends by means of closing walls 14 and 15 and comprises in its interior a tanning or dyeing compartment for the material to be treated. This compartment is accessible for loading and unloading via charging openings in the entire drum which are not specially shown. The charging openings are sealable by means of removable covers or sliding covers which are also not shown and are only indicated diagrammatically in FIGS. 4 and 5. Only FIG. 2 shows charging openings 17 in a portion of the rotary drum 10 still to be described later.

The rotary drum 10 furthermore comprises a hollow shaft 18 for the drum mounting and for the drainage and/or admission of fluid treatment media, as will be described later.

Within the drum jacket 13, there is arranged an internal partially perforated jacket 19 which is coaxial to the latter, is smaller in diameter and is also sealed by means of the frontal closing walls 14 and 15. By this means, an axially passing ring channel is formed between the external circumferential surface of the internal jacket 19 and the internal circumferential surface of the external drum jacket 13.

The internal compartment of the internal jacket 19, forming the tanning or dyeing compartment, is subdivided by means of three perforated radial partition walls 20, 21 and 22, which are arranged approximately in the same angle scale relative to one another and are stiffened by corrugation — which is not shown in detail —into three treatment chambers 23, 24, and 25 which are of equal size and comprise, of course, separate and sealable charging openings, which have been omitted for clarity's sake.

The ring channel between the internal jacket 19 and the drum jacket 13 is subdivided by means of three unperforated and welded-in longitudinal separating webs 26, 27 and 28, which pass in the axial direction, into three axially passing pocket-forming ring-segment channels 29, 30 and 31. These thus form three pockets, each of which is in joint communication, through the perforation of the internal jacket 19, with respectively two treatment chambers 23 to 25 following one another in the circumferential direction. For example, the pocket according to the ring-segment channel 29 is simultaneously in communication with the treatment chambers 23 and 25. In the same way, the pocket according to the ring-segment channel 30 is simultaneously in communication with the treatment chambers 23 and 24, etc. The longitudinal separating web 26 is located in the circumferential direction along the angular area which is bounded by two radial partition walls 22 and 20. The arrangement may be made approximately along half this angular area, which is however mot imperative. The other longitudinal separating webs 27 and 28 are arranged in the same manner. All the longitudinal separating webs 26 to 29 follow one another in the circumferential direction at approximately equal angular distance. As shown above all in FIGS. 1 and 2, the internal jacket 19 comprises, in the area of the longitudinal separating webs 26, 27 and 28, axially passing unperforated surfaces 32, 33 and 34 of approximately rectangular configuration in a development, while the internal jacket 19 is perforated along the remaining circumference. Each longitudinal separating web 26 to 28 is diagonally aligned over its associated rectangular surface 32 and 33 and 34 respectively, as shown particularly in FIGS. 1 and 2.

The hollow shaft 18 penetrates the rotary drum 10 in the centre and in an axially passing manner and is extended at the end that is to the left in FIGS. 1, 6 and 7, and thus at the drive end, beyond the closing wall 14 provided there and is enclosed there by a coaxial pipe socket 35 which is larger in diameter and may be welded to the closing wall 14. The hollow shaft 18 is subdivided over its entire length by means of radial dividing webs 37, 37 and 38, which extend to the centre and as radial extensions of the radial partition walls 20 and 21 and 22 respectively, into three axial channels 39, 40 and 41. The annular space formed between the pipe socket 35 and the hollow shaft 18 is subdivided in a corresponding manner over the entire pipe socket length into three socket channels 45, 46 and 47 by means of radial webs 42, 43 and 44 which extend as radial extensions of the dividing webs 36 and 37 and 38 respectively. The axial channels 39 to 41 are not connected to the socket channels 45 to 47; they are only connected at the drive end by means of a special unit, which will be outlined later.

At the end that is to the left in FIGS. 1, 6 and 7, the rotary drum 10 comprises for each treatment chamber 23, 24 and 25 an approximately radial connecting line 48 and 49 and 50 respectively. For clarity's sake, the connecting line 48 is indicated in FIG. 3*a* in solid lines, the connecting line 49 in broken lines and the connecting line 50 in dash-dotted lines. in a corresponding manner, the rotary drum comprises at the opposite end, which is to the right in FIGS. 1, 6 and 7, in respect of each treatment chamber 23, 24 and 25 also an approximately radial connecting line 51 and 52 and 53 respectively, which are plotted in FIG. 3*b* in conformity with the associated connecting lines shown in FIG. 3*a*.

At the end that is to the left in FIGS. 1, 6 and 7, the following connection is provided for the ends of the connecting lines 48, 49 and 50: With its radially inwardly located end, the connecting line opens into the socket channel 45, the connecting line 49 into the socket channel 46 and the connecting line 50 into the socket channel 47, each channel being associated with the pipe socket 35, while with its radially external end, the connecting line 48 opens into the ring-segment channel 30, the connecting line 49 into the ring-segment channel 31 and the connecting line 50 into the ring-segment channel 29.

The connection relationships of the connecting lines 51 to 53 at the end that is to the right in FIGS. 1, 6 and 7 are as follows: With its radially internal end, the connecting line 51 is connected to the axial channel 39, the connecting line 52 to the axial channel 40 and the connecting line 53 to the axial channel 41, each channel being associated with the hollow shaft 18, while with its externally located end, the connecting line 51 opens into the ring-segment channel 29, the connecting line 52 into the ring-segment channel 30 and the connecting line 53 into the ring-segment channel 31.

Associated with respectively the same treatment chamber are the connecting lines 48 to the left and 51 to the right, furthermore the connecting lines 49 to the left and 52 to the right. Of these pairs, the connecting line that is respectively to the right in FIGS. 1, 6 and 7 does not open into the same ring-segment channel but into a ring-segment channel following thereafter in the direction of rotation according to the arrow A. For example, the connecting line 50 on the left-hand side opens into the ring-segment adjacent 29, but the associated connecting line 53 on the right-hand side opens into the ring-segment channel 31 following thereafter in the direction of rotation according to the arrow A.

It thus follows that a pair of connecting lines associated with a treatment chamber, for example the treatment chamber 25, 50 (to the left) and 53 (to the right) end with their radial external ends directly adjaent to the longitudinal separating web 26, as viewed in the circumferential direction (see also FIG. 2), one line 50 opening on one side thereof into the ring-segment channel 29 divided thereby, while the other right-hand connecting line 53 opens with its external end on the opposite side of the longitudinal separating web 36, as viewed in the cirumferential direction, into the ring-segment channel 31 divided thereby and following in the circumferential direction.

All the connecting lines 48 to 53 are designed as approximately radially extending channels which are frontally welded into their respectively associated treatment chamber and simultaneously contribute to the front-end stiffening of the internal jacket 19 and the closing walls 14 and 15. The channel configuration is particularly evident in FIGS. 1, 2, 4 and 5. The channels are approximately U-shaped in cross section and have a U-shaped opening pointing towards the frontal closing walls 14 and 15. In the area of this U-shaped opening, the channels are shut by means of the internal surface of the associated frontal closing walls 14 and 15. With their radially external end, the channels open via associated breaches in the wall of the internal jacket 19 into the respectively associated ring-segment channel forming an axially passing pocket, as described hereinbefore. With their radially internal end, the channels open into the respectively associated socket channel of the pipe socket 35 and into the associated axial channel of the hollow shaft 18, as has also been described.

It stands to reason that in another exemplified embodiment, which is not shown, the connecting lines 48 to 53 may be designed as hose or tube lines, instead of as welded-in channels, which lines may be arranged, as in the first exemplified embodiment, within the drum jacket 13, as viewed in the radial direction and also in the axial direction, or radially and/or axially outside thereof.

The device furthermore comprises a vessel which is stationary relative to the rotary drum 10 and is arranged at the drum end which is to the left in FIGS. 1, 6 and 7 and carries the pipe socket 35. The vessel 60 is connected to a connecting pipe 61, and, by means of an indicated slide ring seal 62, to the free end of the pipe socket 35. In the transition area towards the free end of the hollow shaft 18, the connecting pipe 61 is subdivided by means of a horizontal dividing web 63 into an inflow channel 64 located thereabove and a return flow channel 65 located therebelow. The inflow channel 64 is taken from the hollow shaft 18 and the pipe socket 35 to the vessel 60, while the return flow channel 65 is taken back from the vessel to the hollow shaft 18 and the pipe socket 35. The inflow channel 64 and the return flow channel 65 are connected through a connecting channel within the vessel. Upstream of the inlet into the return flow channel 65, there is provided a throttle, preferably a throttle orifice which can be sealed by means of a shut-off valve; this is not specially shown for the sake of clarity. The throttle orifice can be sealed by means of the shut-off valve or the like whenever the treatment medium is to be drained from the rotary drum 10 and is not to be returned through the return flow channel 65.

The vessel 60 furthermore comprises a sealable discharge opening which is not specially shown and which can be opened for draining the rotary drum 10 and for discharging the treatment medium from the rotary drum 10 and the vessel 60 or can be closed for the circulation of the liquor. Furthermore connectible to the inflow channel 64 and/or the return flow channel 65 are modular control elements, for example for the addition of fluid or powdery chemicals to the treatment medium, for steam heating by heat of condensation provided by means of a steam injector, for measuring the pH value or the temperature or the like.

Hereinafter, the mode of operation of the device will be described, a start being made from a rotation of the drum 10 in the anti-clockwise sense, that is to say in the direction of the arrow A as shown in FIG. 4.

It is assumed that each treatment chamber 23, 24 and 25 has been charged with material to be treated and that the liquor circulates within the rotary drum 10, the shut-off valve controlling the throttle orifice in the vessel 60 thus being opened and the throttle orifice being uncovered.

A treatment chamber, for example the treatment chamber 24 in the position shown in FIG. 1, will be considered during the rotation of the rotary drum 10. It is apparent that, due to the perforated radial partition walls 20 to 22 and the partially perforated internal jacket 19, the liquor can flow from treatment chamber to treatment chamber and can also flow radially into the individual ring-segment channels 29 to 31. When the treatment chamber 24 has assumed the rotary position shown in FIG. 1, then the liquor flows radially downwards, as indicated by arrows in FIG. 1, both into the left-hand ring-segment channel 30 and into the right-hand ring-segment channel 31, and this respectively over the entire axial length. Due to the diagonal arrangement of the longitudinal separating web 28, the liquor flows within the ring-segment channel 31 with an axial flow component towards the drum end that is to the left in FIG. 1, as indicated by arrows. The liquor thus flows towards the radially external opening of the connecting line 49 which opens into the ring-segment channel 31. The connecting line 53 opening into the same ring-segment channel 31 at the opposite end is not fed by the flow medium, since, as viewed in the circumferential direction, the radially external opening of this connecting line 53 is located much further to the top than is the radially external opening of the connecting line 49 at the end that is to the left in FIG. 1. The liquor thus flows only into the connecting line 49 and is then passed on from this latter radially inwards into that socket channel 46 into which this connecting line 49 opens with its radially internal end. As the rotary drum 10 continues to rotate in the direction of the arrow A, the connecting line 49 will be approximately in the rotary position in which the connecting line 50 is now in FIG. 1. During this rotation, the liquor is thus scooped from the respectively associated treatment chambers at the end that is to the left in FIG. 1 through the connecting lines 48 to 50 provided there, and only through these, and is directed radially inwards into the respectively associated socket channels 45 to 47 of the pipe socket 35. The liquor then passes through the inflow channel 64 (FIGS. 6, 7) into the vessel 60, is deflected therein in the connecting channel through an angle of 180° and passes into the return flow channel 65. From this latter, the liquor is returned in two partial streams into the rotary drum 10. One partial stream returns directly through one or several socket channels of the pipe socket 35 at the end that is to the left in FIG. 1 and flows through the connecting lines 48 to 50 provided there radially outwards and back into the respectively associated ring-segment channels 29 to 31. In these ring-segment channels, the returned partial stream of the liquor is mixed with the liquor left in the rotary drum 10. Only after this mixing has taken place does the liquor then flow radially from the ring-segment channels 29 to 31 back into the respectively associated treatment chambers 23 to 25. This happens over a substantial portion of the axial length of the rotary drum 10, for example over a length extending from the left-hand end in FIG. 1 to approximately the centre.

The other partial stream of the liquor re-introduced into the rotary drum 10 through the return flow channel 65 passes from the return flow channel 65 into the axial channels 39 to 41 of the hollow shaft 18 and passes through the latter as far as the end that is to the right in FIGS. 1, 6 and 7. There, the liquor flows into the connecting lines 51 to 53 located on the right-hand side in FIG. 1, namely through the radially inwardly located ends thereof which open into the hollow shaft 18. The liquor then flows radially outwards in the connecting lines 51 to 53 and passes into the respectively associated ring-segment channels 29 to 31 at the end that is to the right in FIGS. 1, 6 and 7. Therein, mixing is effected with the remaining portion of the liquor disposed in these ring-segment channels 29 to 31. Only then does this partial stream of the liquor also pass radially through the perforated internal jacket 19 into the respectively associated treatment chambers 23 to 25. This alps occurs over a substantial axial length of the drum, for example over half the drum length on the right-hand side.

It can thus be stated that prior to the return of the liquor from the ring-segment channels 29 to 31 into the treatment chambers 23 and 25 intimate mixing occurs therein with the liquor left in the drum. For mixing, the liquor is introduced in the axially opposite direction from one end into the ring-segment channels 29 to 31. This results in an intimate mixing in the axial direction. At the same time, an extremely thorough mixing also takes place in the direction of the circulation of the liquor, that is to say in the circumferential direction. This provides a liquor which is extremely homogeneous with respect to the chemical concentration and, for example, the temperature in all the cross-sectional areas as well as over the entire axial length of the rotary drum 10.

In the vessel 60, namely in the area of the inflow channel 64 or the return flow channel 65, easy access to the liquor is provided at any time during the operation, for example for checking purposes or for a new standardization of the liquor, To this end, it is possible to add fluid or powdery highly concentrated chemicals or hot steam during the operation. Prior to the thus enriched liquor coming again into contact with the material within the treatment chambers 23 to 25, an extremely thorough mixing of the liquor is effected. The material undergoing treatment thus does not come directly into contact with the additions, but comes into contact therewith when these have been uniformly distributed within the liquor.

While the end that is to the left in FIG. 1 scoops the liquor from the drum when the drum rotates in the direction of rotation shown by the arrow A, this scooping occurs at the end that is to the right in FIG. 1 upon a reversal of the direction of rotation and during a rotation in the opposite sense in the direction of the arrow B, namely through the connecting lines 51 to 53 provided there. The flow conditions following therefrom are indicated in FIG. 7. The liquor entering the ring-segment channels 29 to 31 during the rotation is now delivered by the axial component, due to the oblique longitudinal separating webs 26 to 28, at a high flow rate to the end that is to the right in FIG. 1 and passes through the connecting lines 51 to 53 into the respectively associated axial channels 39 to 41 of the hollow shaft 18. The liquor passes through the hollow shaft 18, enters the vessel 60 through the inflow channel 64 and emerges from this vessel through the return flow channel 65. The liquor is then divided into two partial streams, one of which is distributed through the socket channels 45 to 47 in the pipe socket 35 towards the end that is to the left in FIG. 1 and passes through the connecting lines 48 to 50 provided there into the associated ring-segment channels 29 to 31, and this occurs in the axial direction as viewed from left to right in FIG. 1. Then the same happens there as described above with respect to the direction of rotation according to the arrow A. The other partial stream is returned through the axial channels 39 to 41 of the hollow shaft 18 to the end that is to the right in FIG. 1 and is introduced radially from the inside to the outside into the connecting lines 51 to 53 provided there and which deliver this partial stream into the associated ring-segment channels 29 to 31 in the axial direction from right to left according to FIG. 1.

The flow of the liquor from the centre to the vessel 60 and back again to the centre occurs at an extremely high flow rate, due to the constructional design described. The scooping of the liquor from the drum interior radially to the exterior is effected in both directions of rotation according to the arrows A and B.

If the rotary drum 10 is to be drained, then the throttle orifice in the vessel 60 is sealed by means of its shut-off valve and a corresponding discharge hole in the vessel 60 is opened. The liquor can now drain freely, while the rotary drum 10 continues to rotate in one direction of rotation or the other.

In the second exemplified embodiment described in FIGS. 8 and 9, the parts corresponding to the first exemplified embodiments are provided with reference symbols increased by 100, reference thus being made to the description of the first exemplified embodiment in order to avoid any repetition.

The second exemplified embodiment differs from the first in that there is no internal jacket 19 and in that the pockets formed by the ring-segment channels 29 to 31 in the first exemplified embodiment are arranged in the second exemplified embodiment, as shown in FIGS. 8 and 9, at the two axial end areas of the drum jacket 113 between the hollow shaft 118 and the internal circumferential surface of the drum jacket 113. For this purpose, frusto-conical and perforated dividing rings 170, 171 are welded into the drum jacket 113 at the two axial end areas thereof. The dividing rings 170, 171 extend between the hollow shaft 118 and the drum jacket 113 and taper in directions pointing away from one another and towards the drum end. They are arranged in such a way that their edge describing the larger conic base circle rests against the inside of the drum jacket 113 and is secured thereto, while their edge circumscribing the smaller frusto-conical circle rests against the inside of the respective frontal closing wall 114 and 115 and is secured thereto. There is thus provided between the dividing ring 170, 171, on the one hand, and the drum jacket 113 as well as the associated closing walls 114 and 115, on the other hand, an annular space which is approximately triangular in cross section 172 (FIG. 8, on the left-hand side) and 173 (FIG. 8, on the right-hand side). The radial separating walls 120 and 122 extend as they do in the first exemplified embodiment and do not run into the annular spaces 172, 173. The hollow shaft 118 and the pipe socket 135 are designed in the same way as in the first exemplified embodiment.

In the circumferential direction, approximately over the centre of the circumferential angle of each treatment chamber 123, 124, 125, each annular space is subdivided into three ring-segment-shaped pockets 177, 178, 179 by means of respectively one unperforated approximately radial separating web 174, 175, 176, as is shown in FIG. 9 for the annular space 172 only. The pocket 177 is thus divided in the circumferential direction by the separating webs 174, 175, the pocket 178 by the separating webs 175, 176 and the pocket 179 by the separating webs 176 and 174.

As in the first exemplified embodiment, the device according to the second exemplified embodiment also comprises at both drum ends a connecting line for each treatment chamber. Only the connecting lines of the left-hand end are diagrammatically indicated in FIG. 9 and are designated by 180, 181 and 182. These three connecting lines are here designed as pipe lines or hose lines. With their radially internal end, they open into associated socket channels of the pipe socket 135, as in the first exemplified embodiment. At their radially external end, the following junction is provided: The connecting line 180 opens into the pocket 178, the connecting line 181 into the pocket 179 and the connecting line 182 into the pocket 177.

The pockets at the right-hand end in FIG. 8 are designed in the same way as at the left-hand end. As in the first exemplified embodiment, there is also provided a connecting line for each treatment chamber. The connection of the connecting Lines at the right-hand end is also the same as in the first exemplified embodiment, i.e. the connecting lines are connected relative to the connecting lines 180 to 182 at the left-hand end in FIG. 8 by a circumferential staggering by one pocket. By this means, the second exemplified embodiment also ensures that the liquor is scooped from the drum interior in both directions of rotation of the rotary drum through the pockets at one drum end or the other drum end, depending on the direction of rotation, and is conducted through the connecting lines to the vessel, which is not shown, and is then taken back again into the pockets and the drum interior. The second exemplified embodiment thus corresponds in its mode of operation to the first, so that no special description is required.

In the third exemplified embodiment shown in FIGS. 10 and 11, reference symbols increased by 200 have been used for the parts corresponding to the first and second exemplified embodiments, so that reference is thus made to the description of the previous exemplified embodiments.

It is discernible that the radial partition wall 220 comprises over its axial and radial extensions bonding the treatment chambers adjoining on both sides pocket-shaped chambers 285. In the exemplified embodiment shown, altogether five of such chambers 285 are provided. The chambers 285 are perforated on both sides in the circumferential direction and open in the radial direction towards the outside. With these last-mentioned openings the chambers 285 open into the respectively associated ring-segment channels, which are not shown, that is to say the ring-segment channels 29, 30 and 31 shown in FIG. 1. The outlet is shown by the arrows 286 in FIG. 10, which illustrate that when the rotary drum is rotating the liquor flows through the chambers 285 in the radial direction towards the exterior and vice versa.

As can be seen, the radial partition wall 220 is double-walled over the surface area extending outside the hollow shaft 218. The radial partition wall 220 is of corrugated design. In each area of a corrugated trough 287, it comprises a perforated cover wall 288 extending in the circumferential direction at a short distance from the corrugated trough 287. Thus, a corrugated trough 287 and a cover wall 288, both of which are perforated, form a pocket-like chamber 285.

At least one approximately web-like projection, acting like a paddle, may be arranged on each side of the radial partition wall 220 — as is shown only for one side in FIGS. 10 and 11. In the exemplified embodiment shown, the radial partition wall 220 carries two such projections 289 and 290. Both projections protrude from the radial partition wall 220 at approximately right angles and project into the invisible treatment chamber which is divided by the radial partition wall 220. The projections 289 and 290 are arranged in the axial direction at distances of equal size from the associated frontal closing walls 214 and 215. Their distance from the longitudinal central axis of the rotary drum is relatively short. The projections 289 amd 290 are arranged in the radial direction at a short distance from the hollow shaft 218. Their function is to roll the material undergoing treatment over additionally, without damaging the latter when the rotary drum is rotated.

In other exemplified embodiments not shown, either only one single web-like projection is provided or a plurality of such projections which also extend, of course, on both sides of the radial partition wall 220.

Instead, the projections 289, 290 may be arranged radially further outside and/or on the internal jacket of the rotary drum, when they will point radially inwards. It is then possible to bring about special effects on the material undergoing treatment, for example in the case of leather a widening or stretching thereof during the treatment process.

I claim:

1. A device for tanning, dyeing or the like, comprising (a) a horizontal rotary drum including a drum jacket having closing walls effecting sealing at the front ends and containing in its interior a tanning or dyeing compartment, which is accessible for loading and unloading via sealable charging openings in the drum jacket, (b) a hollow shaft, which communicates with the tanning or dyeing compartment, for mounting the drum and for the drainage and/or intake of fluid treatment media, (c) radial partition walls subdividing said compartment which walls are arranged relative to one another in approximately the same angle displacement into a number of treatment chambers corresponding to the number of radial partition walls, which chambers are of approximately equal size and each comprise a separate sealable charging opening;

(d) the rotary drum comprises, at least approximately in the area of its two frontal ends and in the radial direction, on its exterior a number of pockets corresponding to the number of the treatment chambers, each pocket being in joing communication with respectively two treatment chambers following one another in the circumferential direction;

(e) the hollow shaft penetrates the rotary drum in the centre and in an axially passing manner and extends it at one end, beyond the frontal closing wall and is surrounded by a coaxial pipe socket which is larger in diameter; and (f) the rotary drum comprises at each axial drum end for each individual treatment chamber an approximately radial connecting line and of which those located at one frontal drum end open with their one end into the annular space between the hollow shaft and the pipe socket and those located at the opposite drum end open with their one end into the interior of the hollow shaft, while all the connecting lines are connected with their other end to a respectively associated pocket in such a way that respectively two connecting lines located opposite at the front ends of the drum open in respect of each treatment chamber into the pockets located at the same circumferential level or staggered relative to one another in the circumferential direction, whereby during the rotation of the rotary drum in one direction of rotation the treatment medium emerges approximately radially from a treatment chamber and enters a pocket in the area of one front drum end, flows from this pocket through the connecting line thereof into the annular space between the hollow shaft and the pipe socket and returns therefrom, after deflection and possibly a simultaneous medium treatment, such as heating, concentration check etc., as a partial stream through one of the connecting lines at this drum end into a pocket provided there and through this latter, while being mixed with the treatment medium disposed in this pocket, approximately radially into a treatment chamber; the other partial stream flowing simultaneously through the hollow shaft in the axial direction to the opposite drum end and through a connecting line into an associated pocket being mixed with the treatment medium contained therein, and then flowing from this pocket approximately inwards into the same treatment chamber or one that follows in the direction of rotation and in that during the rotation of the rotary drum in the direction of rotation opposite thereto a corresponding scooping of the treatment medium occurs at the other frontal drum end and in the opposite flow direction.

2. A device according to claim 1, wherein the hollow shaft is subdivided over its entire length by means of radial dividing webs which stretch to the centre and extend as radial extensions of the radial partition walls into a number of axial channels corresponding to the number of treatment chambers and in that of the connecting lines provided for each treatment chamber those which are connected to the interior of the hollow shaft open into that axial channel which is associated with the respective treatment chamber and extends within this latter.

3. A device according to claim 1, wherein the annular compartment between the pipe socket and the hollow shaft is subdivided over the entire pipe socket length by means of radial webs extending as radial extensions of the dividing webs of the hollow shaft into a number of socket channels corresponding to the number of treatment chambers and in that of the connecting lines provided for each treatment chamber those which are connected to the annular space of the pipe socket open into that socket channel which is associated with the respective treatment chamber and extends as an axial extension thereof.

4. A device according to claim 1, wherein the radial partition walls are corrugated in design and are preferably welded in.

5. A device according to claim 1, wherein by a vessel which is stationary relative to the rotary drum and which is connected to a connecting pipe and, by means of a slide ring seal to the free end of the pipe socket at the axial drum end at which the pipe socket with the axially extended hollow shaft is provided.

6. A device according to claim 1, wherein the connecting pipe is subdivided along the transition area to the free end of the hollow shaft by means of a horizontal dividing web into an upper half and a lower half, the channel above the dividing web forming an inflow channel from the hollow shaft and the pipe socket towards the vessel and the channel below the dividing web forming a return flow channel from the vessel back into the hollow shaft and the pipe socket.

7. A device according to claim 1, wherein the inflow channel and the return flow channel are connected within the vessel through a connecting channel comprising a throttle, preferably a throttle orifice, which is arranged in the flow direction upstream of the return flow channel.

8. A device according to claim 1, wherein the return flow channel, preferably the throttle orifice thereof, can be sealed by means of a shut-off valve or the like for draining the treatment medium from the rotary drum.

9. A device according to claim 8, wherein the vessel comprises a sealable discharge port for discharging the treatment medium from the rotary drum and the vessel.

10. A device according to claim 6, wherein modular control elements, for example for the addition of fluid or powdery chemicals to the treatment medium, for steam heating through heat of condensation by means of a steam injector, for the measurement of the pH value or temperature or the like, are connectible to the inflow channel and/or the return flow channel.

11. A device according to claim 1, wherein the connecting lines are designed as hose or pipe lines.

12. A device according to claim 1, wherein the connecting lines are arranged in the interior of the rotary drum.

13. A device according to claim 1, wherein of the two radial partition walls dividing a treatment chamber in the circumferential direction one radial partition wall forms, irrespective of the direction of rotation of the rotary drum, a feeding base facilitating the loading of the treatment chamber by machine and an unloading chute facilitating unloading.

14. A device according to claim 1, wherein viewed in the radial direction, the pockets are arranged within the drum jacket.

15. A device according to claim 14, wherein the pockets are arranged along both axial end areas of the drum jacket between the hollow shaft and the internal circumferential surface of the drum jacket.

16. A device according to claim 15, wherein frusto-conical and perforated dividing rings which extend between the hollow shaft and the drum jacket and taper in the direction pointing away from one another and towards the drum ends, are arranged within the drum jacket at the two axial end areas thereof in such a way that their edge describing the conic base circle rests against the inside of the drum jacket and is secured thereto, while their edge circumscribing the smaller frusto-conical circle rests against the inside of the respective frontal closing wall and is secured thereto.

17. A device according to claim 16, wherein the annular space which is enclosed between the dividing ring on the one hand, and the drum jacket as well as the frontal closing wall respectively, on the other hand, and which is approximately triangular in cross section, is clear of the radial partition walls at both drum ends and is subdivided in the circumferential direction into a number of ring-segment-shaped pockets corresponding to the number of treatment chambers approximately along the centre of the circumferential angle of a treatment chamber by means of respectively one unperforated, approximately radial separating web to which pockets respectively one connecting line is connected with its one end.

18. A device according to claim 17, wherein the ring-segment-shaped pockets are arranged at one drum end without any circumferential staggering and at the same circumferential level as those arranged at the opposite drum end, and in that the connection of the connecting lines at one drum end is effected with their one end to the ring-segment-shaped pockets with a circumferential staggering by one pocket relative to those at the other drum end.

19. A device according to claim 1, wherein for the formation of the pcokets there is arranged within the drum jacket a partially perforated internal jacket which is coaxial to the latter and is smaller in diameter and is preferably also sealed by means of the frontal closing walls in such a way that an axially passing ring channel is formed between the external circumference of the internal jacket and the internal circumference of the drum jacket and in that the ring channel is clear of the radial partition walls and is subdivided in the circumferential direction along the angular area of a treatment chamber bounded between two radial partition walls by means of respectively one unperforated longitudinal separating web which passes in the axial direction, into a number of axially passing pocket-forming ring-segment channels corresponding to the number of treatment chambers, to which channels respectively one connecting line is connected with its one end.

20. A device according to claim 19, wherein the internal jacket comprises for each treatment chamber an axially passing unperforated surface having an approximately rectangular shape in a development and perforations over the remaining circumference, and in that the longitudinal separating web in respect of each treatment chamber is aligned diagonally to the rectangular surface.

21. A device according to claim 20, wherein the two connecting lines opposite to one another at the frontal drum ends end in respect of each treatment chamber with one end directly adjacent to the longitudinal separating web, as viewed in the circumferential direction, one on one side of the longitudinal web and in the one ring-segment channel divided thereby and the other on the other side of the longitudinal separating web, as viewed in the circumferential direction, and in the divided ring-segment channel following in the circumferential direction in such a way that when the rotary drum rotates in one direction of rotation the treatment medium flows from the axially passing pockets towards one axial side and into the connecting lines provided there, while it flows from the pockets towards the other axial side and into the connecting lines disposed there when the rotation occurs in the opposite direction of rotation.

22. A device according to claim 19, wherein the connecting lines are designed as approximately radially extending channels which are frontally welded into the treatment chambers and are simultaneously formed so as to provide a frontal stiffening of the internal jacket.

23. A device according to claim 22, wherein the channels are approximately U-shaped in cross section, with the U-shaped orifice pointing to the frontal closing wall.

24. A device according to claim 23, wherein the channels are shut in the area of their U-shaped orifices by means of the internal surface of the frontal closing wall, open with their radially external end via breaches in the wall of the internal jacket into the respectively associated ring-segment channel forming an axially passing pocket and with their radially internal end into the respectively associated socket channel of the pipe socket and the axial channel of the hollow shaft respectively.

25. A device according to claim 19, wherein a charging opening which is sealable by means of a detachable cover or a sliding cover, is provided in respect of each treatment chamber on the drum jacket and at an associated point of the internal jacket.

26. A device according to claim 1, wherein over their axial and radial extensions bounding the treatment chambers the radial partition walls comprise pocket-shaped chambers which are perforated in the circumferential direction on both sides and which are open radially to the exterior and open out into the respectively associated ring-segment channels.

27. A device according to claim 26, wherein the radial partition walls are at least partially double-walled for the formation of the chambers.

28. A device according to claim 26, wherein that with a corrugated design the radial partition walls comprise in the area of respectively one corrugation trough a perforated cover wall which extends in the circumferential direction at a short distance from the corrugation trough and which forms a chamber together with the corrugation trough.

29. A device according to claim 1, wherein on each side of the radial partition walls there is arranged at least one approximately web-like projection which protrudes approximately at right angles from the radial partition wall and projects into the respective treatment chamber.

* * * * *